US006681815B1

(12) United States Patent
Westrich et al.

(10) Patent No.: US 6,681,815 B1
(45) Date of Patent: Jan. 27, 2004

(54) AUTOMATIC TRUCK TANK FILL SYSTEM

(75) Inventors: Milton Westrich, South Orange, NJ (US); Steve Apelman, Centereach, NY (US); Alan Wehner, Branchville, NJ (US)

(73) Assignee: Blend-Rite Industries, Inc., South Orange, NJ (US)

( * ) Notice: Subject to any disclaimer, the term of this patent is extended or adjusted under 35 U.S.C. 154(b) by 0 days.

(21) Appl. No.: 10/119,644

(22) Filed: Apr. 10, 2002

Related U.S. Application Data

(60) Provisional application No. 60/285,011, filed on Apr. 19, 2001.

(51) Int. Cl.[7] ..... B65B 1/04

(52) U.S. Cl. ..... 141/95; 141/198; 141/83; 141/301

(58) Field of Search ..... 141/83, 94, 95, 141/192, 198, 286, 301, 67

(56) References Cited

U.S. PATENT DOCUMENTS

| | | | | | |
|---|---|---|---|---|---|
| 4,763,683 | A | * | 8/1988 | Carmack | 137/68.15 |
| 4,805,672 | A | * | 2/1989 | Berrettini et al. | 141/5 |
| 5,429,159 | A | * | 7/1995 | Tees et al. | 141/59 |
| 5,507,326 | A | * | 4/1996 | Cadman et al. | 141/198 |
| 5,515,890 | A | * | 5/1996 | Koeninger | 141/94 |
| 5,651,400 | A | * | 7/1997 | Corts et al. | 141/59 |
| 5,967,174 | A | * | 10/1999 | MacDonald | 137/312 |
| 6,397,903 | B1 | * | 6/2002 | Coates et al. | 141/94 |

* cited by examiner

*Primary Examiner*—Steven O. Douglas
(74) *Attorney, Agent, or Firm*—Webb Ziesenhiem Logsdon Orkin & Hanson, P.C.

(57) ABSTRACT

An automatic truck tank fill system that includes an arrangement to automatically shut off the flow of material to a truck tank. The arrangement includes break-away connections that minimize damage to the fill system in an event that the truck tank is moved with the fill system still connected to the truck tank.

14 Claims, 2 Drawing Sheets

AUTOMATIC TRUCK TANK FILL SYSTEM

This applications claims the benefit of provisional Ser. No. 60/285,011 filed Apr. 19, 2001.

BACKGROUND OF THE INVENTION

1. Field of the Invention

The present invention relates in general to equipment for filling mobile tanks, and more particular, to an automatic truck tank fill system.

2. Description of the Prior Art

Many industrial vehicles that use water often have water storage tanks attached to them. Such industrial vehicles include water trucks for street cleaning, fire trucks, and cement concrete trucks. Typically, these trucks are filled manually by an operator, usually the driver of the truck. The operator must remain at the truck while the truck is being filled with water in order to stop the water flow whenever the operator sees that the tank is full. Oftentimes, that individual will become distracted at times and allow the tank to overflow. The water used to fill these tanks is usually classified as processed water and, thus, any runoff is not cost effective. Also, processed water running off into the ground is usually considered an environmental risk. Reducing the amount of processed water runoff will, in turn, reduce treatment costs associated with clean-up of the runoff water, thereby lowering water contaminant volumes and, thus, the possibility of EPA-generated questions concerning water runoff.

Typically, automatic truck tank fill systems are not used because the truck is movable. Also, filling a truck tank may take a considerable amount of time. If an operator does not monitor the filling of the truck tank, it is very common in the industry that movable trucks will take off with the hose attachments still in place, thereby damaging the water refill system and/or truck. This usually occurs when the operator of the fill system is not the driver of the truck.

It is therefore an object of the present invention to overcome the above mentioned problems by providing a simple, robust, automatic truck tank fill system that will automatically shut off when the truck tank is full and will not damage the truck and/or automatic truck tank fill system if the truck pulls out when the fill system is still attached to the truck.

SUMMARY OF THE INVENTION

The present invention is an automatic truck tank fill system that may be used to fill tanks on trucks such as concrete trucks and street cleaning water trucks. The automatic truck tank fill system includes a conduit adapted to be in fluid communication with a fluid supply source, a valve connected to one end of the conduit, a sensor for determining the presence of a fluid material connected to an opposite end of the conduit, and a controller in electrical communication with the valve and the sensor, wherein the controller causes the valve to open and close. The conduit can be in fluid communication with a fluid supply source that supplies fluid material such as water. The conduit includes a pipe having a first end and a second end and a flexible hose having a first hose end and a second hose end. The second end of the pipe is coupled to the first hose end of the hose. The second end of the pipe can also be releasably coupled to the first hose end of the hose using a hose breakaway connector. The hose breakaway connector permits the hose to detach from the pipe when a pulling force is applied to the hose, thus preventing damage to the pipe and the fluid supply source. The conduit can also include a fill spout connected to the second hose end of the hose.

The valve, which can be a control solenoid valve, is installed adjacent the first end of the pipe. The sensor, which can be a level sensor, is attached to the fill spout. The sensor is capable of being in a first state and a second state. The controller is electrically and releasably connected to the sensor using an electronic breakaway connector. The electronic breakaway connector easily disconnects the sensor from the controller when a pulling force is applied to the sensor, thus preventing damage to the controller when a truck pulls out with the fill system still connected to the truck tank.

The controller includes a start control and a stop control. The start control when activated, transmits a signal to the controller causing the valve to open. The stop control when activated, transmits a signal to the controller causing the valve to close. Also, the sensor when activated from the first state to the second state, transmits a signal to the controller thereby causing the valve to close. The sensor, which can be made of stainless steel, is activated from the first state to the second state when fluid material in the tank comes in contact with the sensor, thus indicating that the truck tank is full.

The present invention can also include a pump in fluid communication with the conduit. The pump is also in electrical communication with the controller. The start control when activated, transmits a signal to the controller causing the pump to start and the valve to open. The stop control when activated, transmits a signal to the controller causing the pump to stop and the valve to close. Also, when the sensor is activated from the first state to the second state, a signal is transmitted to the controller thereby causing the valve to close and the pump to stop.

The present invention can also include radio frequency units wherein the controller communicates with the sensor by radio frequency waves. A first radio frequency unit is connected to the sensor and a second radio frequency unit is connected to the controller, wherein the first radio frequency unit communicates with the second radio frequency unit.

The present invention further includes an alarm electrically connected to the controller. The alarm can be a visual display such as blinking lights or an audible sound. The controller activates the alarm when the valve closes and/or the pump shuts off.

In operation, filling a truck tank using an automatic truck tank fill system includes the steps of first placing a truck tank adjacent a fill system. Next, a level sensor in a first state is provided. Third, one end of a conduit and the level sensor is placed into an opening in the tank. Fourth, the tank is filled with fluid material flowing from the conduit which is in fluid communication with a fluid supply source. Finally, the fluid material flowing in the tank is stopped when the sensor is in a second state. An alarm can also be activated when material flowing to the tank is stopped.

DETAILED DESCRIPTION OF THE INVENTION

Figure 1:
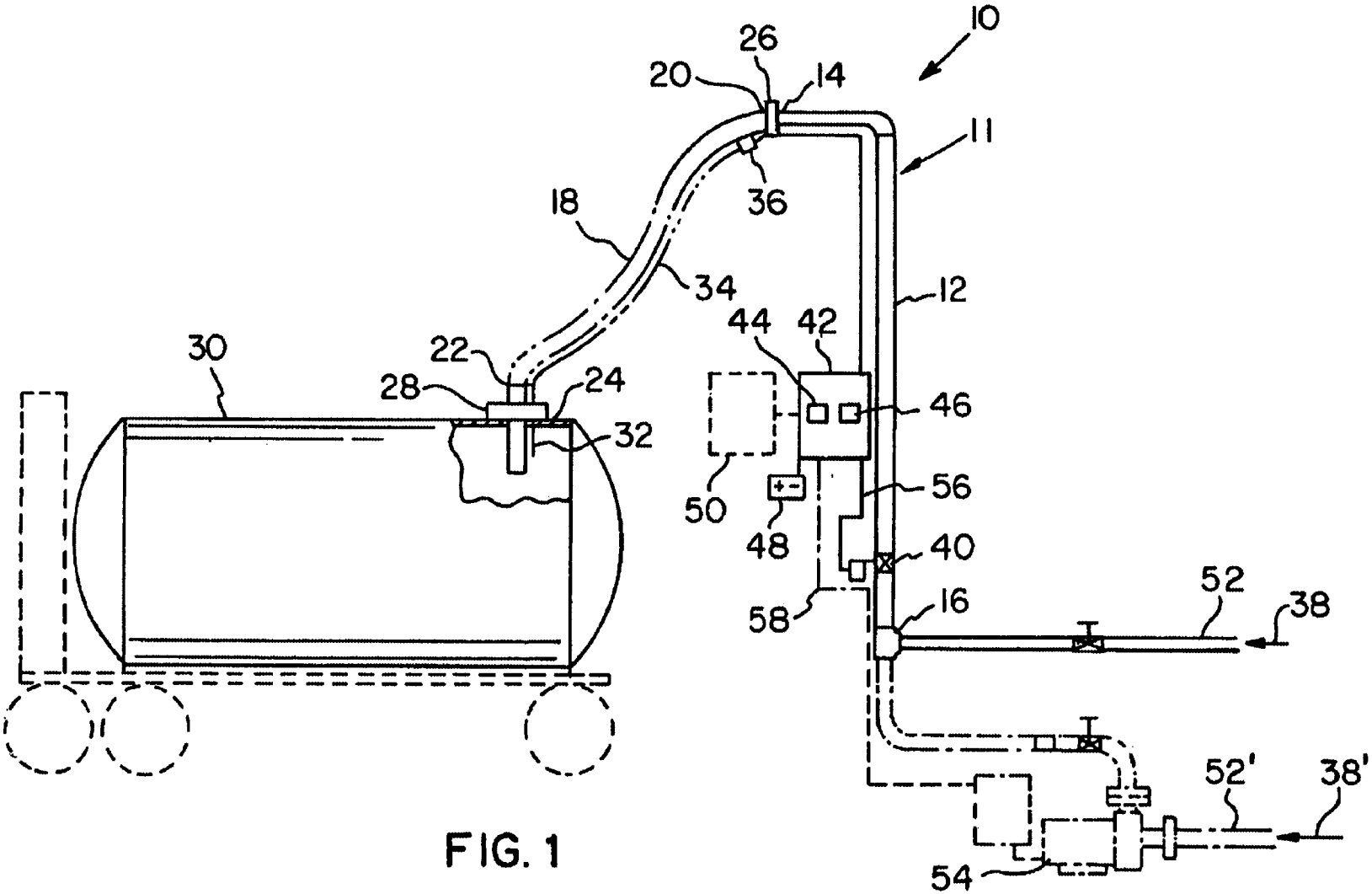
FIG. 1 is a front elevation view of an automatic truck tank fill system made in accordance with the present invention having a fill spout inserted into a truck tank.

FIG. 1 shows an automatic truck tank fill system 10 made in accordance with the present invention. The fill system 10 includes a conduit 11 in fluid communication with a fluid supply source 38, 38'. The conduit 11 includes a pipe 12 having a first end 14 and a second end 16 and a flexible hose 18 having a first hose end 20 and second hose end 22. The first end 14 of the pipe 12 is coupled to the first hose end 20 of the hose 18. A hose breakaway connector 26 is used to releasably couple the first end 14 of the pipe 12 to the first hose end 20 of the hose 18. Breakaway connectors are well known in the art and therefore will not be discussed herein. The second hose end 22 is connected to a fill spout 28. The fill spout 28 is adapted to fit inside an opening 24 of a truck tank 30. The fill spout 28 also has an attached level sensor 32 for determining the presence of a fluid material such as water whenever the material comes in contact with the sensor 32. Typically, this occurs when the truck tank 30 is full. The level sensor 32 is capable of being in a first state and a second state and can be operated through optics, electrical resistance and/or electrical compacitance. The sensor 32 is electrically connected to a controller 42 via a sensor wire 34. The sensor wire 34 can include an electronic breakaway connector 36 positioned therebetween for electrically and releasably connecting the sensor 32 to the controller 42. Adjacent the second end 16 of the pipe 12 is a control solenoid valve 40 that opens and closes, thereby starting and stopping the material flow to the truck tank 30. The controller 42 having a start control 44 and a stop control 46 is electronically connected to the valve 40. The controller 42, which is powered by a power supply 48, causes the valve 40 to open and close. A supply line 52 is attached to the second end 16 of the pipe 12 and is used to supply material from a fluid supply source through the conduit 11 to the truck tank 30.

Shown in phantom in FIG. 1 is a pump 54 in fluid communication with the pipe 12. A pump line 52' attached to the second end 16 at the pipe 12 and is used to supply material from a fluid supply source 38' through the pump 54 and the conduit 11 to the truck tank 30. The pump 54 is also electronically connected to the controller. Also shown phantom in FIG. 1 is an alarm 50 electrically connected to the controller 42. The alarm 50 can be an audible or visible display.

Figure 2:
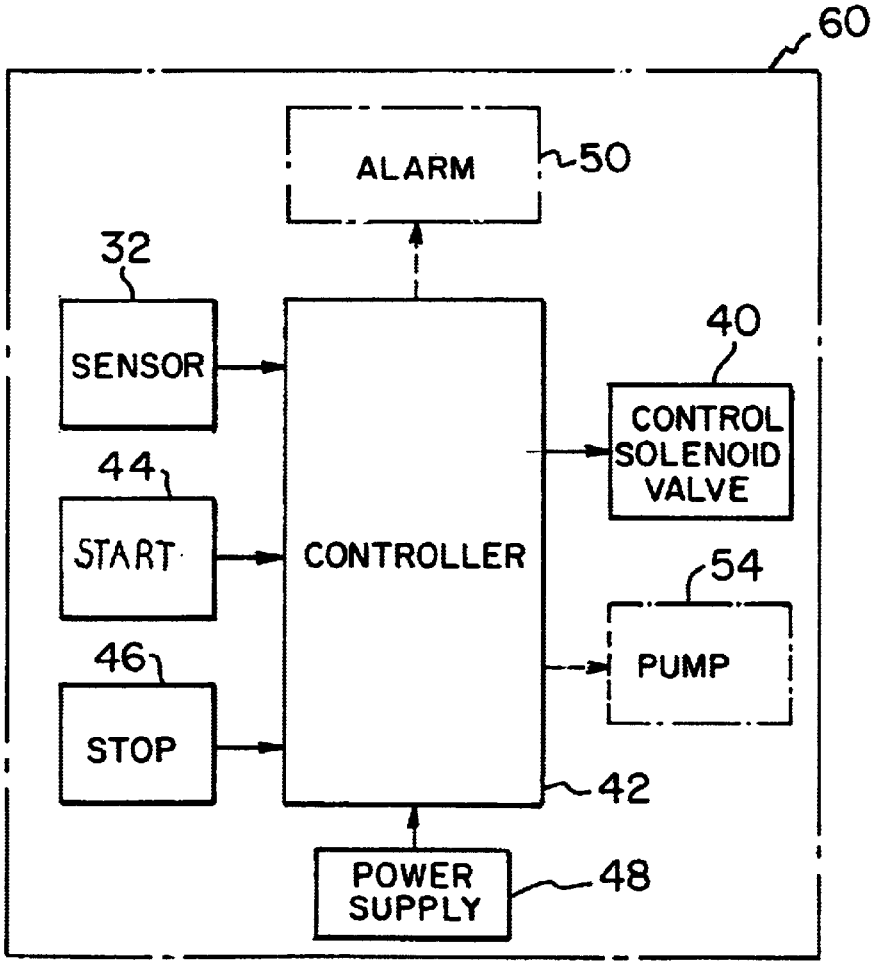
FIG. 2 is a block diagram of a control scheme of the automatic truck tank fill system shown in FIG. 1.

FIG. 2 is a block diagram of a control scheme 60 for the automatic truck tank fill system 10. The power supply 48 is used to supply power to the controller 42. The controller 42 having the start control 44 and the stop control 46 is used to operate the fill system 10. When the start control 44 is activated, a signal is transmitted to the controller 42 causing the valve 40 to open. If the pump 54 (shown in phantom) is used, activating the start control 44 will transmit a signal to the controller 42 causing the pump 54 to start and the valve 40 to open. When the stop control 46 is subsequently activated, a signal is transmitted to the controller 42 causing the valve 40 to close and/or the pump 54 to stop.

The sensor 32 is in the first state, when the sensor 32 is not in contact with the fluid material in the truck tank 30. No signal is transmitted to the controller 32 when the sensor 32 is in the first state. When the sensor 32 is activated from the first state to the second state by the material in the truck tank 30 contacting the sensor 32, shown in FIG. 1, a signal is transmitted to the controller 32 causing the valve 40 to close and/or the pump 54 to stop. The controller 42 also has a potentiometer that is capable of compensating for the relative resistance of the fluid such as water contacting the sensor 32. An adjustable timer can be used to delay the closing of the valve 40 and/or the stopping of the pump 54 after the sensor 32 or the stop control 46 is activated in order to effectively fill the truck tank 30 to the maximum desired level. In addition, the controller 42 causes the alarm 50 (shown in phantom) to activate when the valve 40 closes. Activation of the alarm 50 will produce either an audible sound or visual display, thus alerting the operator that the truck tank 30 is full and/or material flow to the truck tank 30 has stopped.

The control scheme 60 also has a fail safe mode. If there is an electrical power interruption where the power supply 48 ceases to supply power to the controller 42, the controller 42 will cause the valve 40 to close and/or the pump 54 to shut off. The valve 40 is normally in the closed position when there is no electrical power. When power is subsequently restored to the controller 42, the valve 40 remains closed and/or the pump 54 remains shut off. This fail safe arrangement requires the user to activate the start control 44 to continue the filling process.

Figure 3:
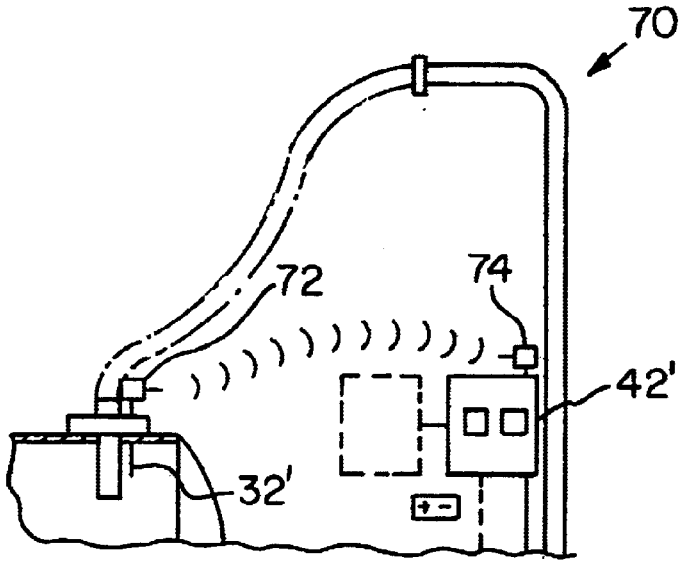
FIG. 3 is a partial front elevation view of a second embodiment of an automatic truck tank fill system that is similar to that shown in FIG. 1, having radio frequency units.

FIG. 3 shows a second embodiment of an automatic truck tank fill system 70 that is similar to the fill system shown in FIG. 1, except that the sensor wire 34 and the electronic breakaway connector 36 are eliminated and replaced with radio frequency units 72, 74. A level sensor 32' is electrically connected to a controller 42' by way of radio frequency waves. A first radio frequency unit 72 is attached to the sensor 32' and a second radio frequency unit 74 is attached to the controller 42'. The first radio frequency unit 72 is used to transmit a signal from the sensor 32' to the second radio frequency unit 74. The second radio frequency unit 74 is used to receive the signal from the first radio frequency unit 72 and transmit the received signal to the controller 42'.

In operation, the driver of the truck tank places the truck tank 30 adjacent to the automatic truck tank fill system 10. The fill spout 28 and the attached level sensor 32 in a first state is inserted into the opening 24 of the truck tank 30 by the operator. The operator then activates the start control 44 thereby opening the valve 40 and/or starting the pump 54. Fluid material from the fluid supply source 38, 38', starts to flow to the truck tank 30. The operator does not need to watch the filling of the truck tank 30. When the material in the truck tank 30 contacts the level sensor 32, thus indicating that the truck tank 30 is full, the sensor 32 will activate to a second state, thereby causing the controller 42 to close the valve 40 and/or shut off the pump 54. The alarm 50 will activate when the valve 40 closes, thus alerting the operator that the truck tank 30 is fill. The operator then removes the fill spout 28 from the opening 24 in the truck tank 30. Next, the operator then shuts off the alarm 50 by activating the stop control 46. If the operator is inattentive to the alarm 50, or if the automatic truck tank system 10 does not have the alarm 50, it is possible that the operator could move his truck with the fill spout 28 still inside the opening 24 of the truck tank 30. If this occurs, the hose breakaway connector 26 will cause hose 18 to disconnect from the pipe 12 and the electronic breakaway connector 36 will cause the sensor wire 34 to disconnect from the controller 42, thereby reducing the damage to the fill system 10.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limited as to the scope of the invention which is to be given the full breath of the appended claims and any and all equivalence thereof.

What is claimed is:

1. An automatic truck tank fill system comprising:

a conduit adapted to be in fluid communication with a fluid supply source;

a valve connected to one end of said conduit;

a sensor for determining the presence of a fluid material is connected to an opposite end of said conduit; and a controller in electrical communication with said valve and said sensor, wherein said controller causes said valve to open and close, and wherein said controller is electrically and releasably connected to said sensor via an electronic breakaway connector.

2. The fill system as claimed in claim 1, wherein said sensor is capable of being in a first state and a second state.

3. The fill system as claimed in claim 2, further comprising a pump in fluid communication with said conduit.

4. The fill system as claimed in claim 3, wherein said pump is in electrical communication with said controller.

5. The fill system as claimed in claim 1, wherein said conduit comprises a pipe having a first end and a second end and a flexible hose having a first hose end and a second hose end, wherein said second end of said pipe is coupled to said first hose end of said hose.

6. The fill system as claimed in claim 5, wherein said second end of said pipe is releasably coupled to said first hose end of said hose using a hose breakaway connector.

7. The fill system as claimed in claim 5, further comprising a fill spout connected to said second hose end of said hose.

8. The fill system as claimed in claim 7, wherein said sensor is attached to said fill spout.

9. The fill system as claimed in claim 1, wherein said controller comprises a start control and a stop control, said start control when activated, transmits a signal to said controller causing said valve to open, and said stop control when activated, transmits a signal to said controller causing said valve to close.

10. The fill system as claimed in claim 3, wherein said controller comprises a start control and a stop control, said start control when activated, transmits a signal to said controller causing said pump to start and said valve to open, and said stop control when activated, transmits a signal to said controller causing said pump to stop and said valve to close.

11. The fill system as claimed in claim 2, wherein said sensor when activated from said first state to said second state, transmits a signal to said controller thereby causing said valve to close.

12. The fill system as claimed in claim 3, wherein said sensor when activated from said first state to said second state, transmits a signal to said controller thereby causing said valve to close and said pump to stop.

13. The fill system as claimed in claim 1, further comprising an alarm electrically connected to said controller, wherein said controller activates said alarm when said valve closes.

14. An automatic truck tank fill system comprising:

a pipe having a first end and a second end, said first end of said pipe adapted to connect to a fluid supply source;

a flexible hose having a first hose end and a second hose end, said first hose end of said hose detachably connected to said second end of said pipe;

a valve defined in said pipe;

a fill spout attached to said second hose end of said hose;

a level sensor capable of being in a first state and a second state attached to said fill spout; and a controller having a start control and a stop control, said controller electrically connected to said valve, and said controller electronically and releasably connected to said sensor via an electronic breakaway connector, wherein said controller causes said valve to open when said start control is activated, and wherein said controller causes said valve to close when said sensor is in the second state and/or said stop control is activated.

* * * * *